US006251475B1

(12) United States Patent
Andriessen et al.

(10) Patent No.: US 6,251,475 B1
(45) Date of Patent: Jun. 26, 2001

(54) PREPARATION OF A MAGNETIC LAYER

(75) Inventors: Hieronymus Andriessen, Berse; Steven Lezy, Antwerp, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/302,404

(22) Filed: Apr. 30, 1999

Related U.S. Application Data

(60) Provisional application No. 60/112,073, filed on Dec. 14, 1998.

(30) Foreign Application Priority Data

Oct. 26, 1998 (EP) ..... 98203868

(51) Int. Cl.[7] ..... B05D 5/12

(52) U.S. Cl. ..... 427/132; 427/128; 427/213.3; 427/216; 427/435; 427/443.1; 427/443.2

(58) Field of Search ..... 427/128, 132, 427/216, 213.3, 435, 443.1, 443.2

(56) References Cited

U.S. PATENT DOCUMENTS 3,790,407 * 2/1974 Merten et al. .

FOREIGN PATENT DOCUMENTS 0 793 242 9/1997 (EP) .

OTHER PUBLICATIONS

Patent Abstracts of Japan, vol. 014, No. 325 (P–1075) , Jul. 12, 1990 & JP 02 108221 A (Mitsubishi Kasei Corp.) Apr. 20, 1990.

Patent Abstracts of Japan, vol. 007, No. 069 (C–158) , Mar. 23, 1983 & JP 58 003963 A (Nippon Denki KK) , Jan. 10, 1983.

Patent Abstracts of Japan, vol. 006, No. 143 (C –117) , Aug. 3, 1982 & JP 57 067156 A (NEC Corp.) , Apr. 23, 1982.

* cited by examiner

*Primary Examiner*—Bernard Pianalto
(74) *Attorney, Agent, or Firm*—Breiner & Breiner

(57) ABSTRACT

A process is disclosed for the preparation of semi-soft or soft magnetic layers. The process involves chemical reduction in aqueous medium of one or more types of metal ions including nickel ions, washing the resulting dispersion of metal particles, and coating this dispersion onto a support.

The resulting magnetic layers can be used in an anti-theft system.

7 Claims, 1 Drawing Sheet

PREPARATION OF A MAGNETIC LAYER

The application claims the benefit of U.S. Provisional Application No. 60/112,073 filed Dec. 14, 1998.

FIELD OF THE INVENTION

The present invention relates to the preparation of particular types of magnetic layers and to their use in an anti-theft system.

BACKGROUND OF THE INVENTION

The lagging of magnetization behind the magnetizing force as the magnetic condition of a ferromagnetic material is changed, e.g. when applying an alternating external field, is called magnetic hysteresis. When a ferromagnetic sample that is initially demagnetized is subjected to an increasing external magnetic field H it reaches a particular flux density $B_{sat}$ at the maximum value of H. When the value of H is decreased again the decreasing flux density does not follow the path of increase but decreases at a rate less than that at which it rose. When H has reached zero again the value of B is not reduced to zero but to a value called the retentivity or remanence. The sample has retained a permanent magnetization. The value of B may be reduced to zero by reversing th magnetic field to negative and increasing its value to the so-called coercive force or coercivity. By further increasing H to negative values and then again reversing its direction a hysteresis loop as represented in FIG. 1 is completed.

BRIEF AND DETAILED DESCRIPTION OF THE DRAWINGS

Figure 1:
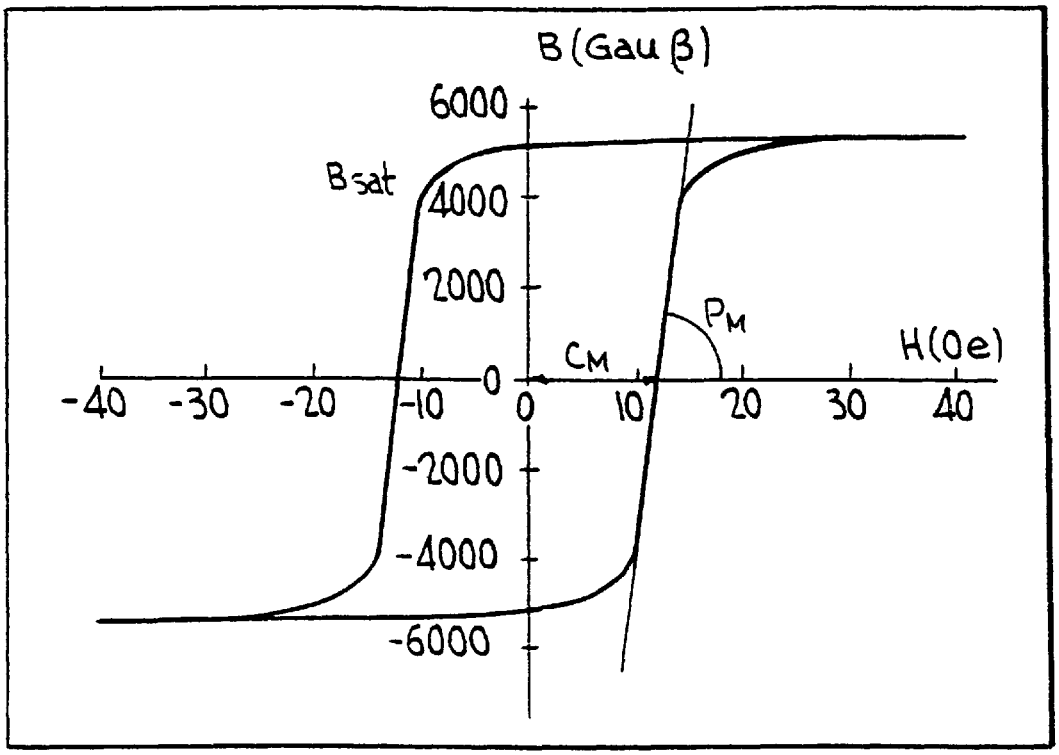

We define in the curve of FIG. 1:

the saturation magnetization $B_{sat}$ which is proportional to the amount of material;

the coercive force $C_M$ which is dependent on the chemical composition, the particle size, the temperature, etc.;

the magnetic permeability (susceptibility or permitivity) $P_M$ which is dependent on the chemical composition, the degree of deformation of the material, etc.

A so-called soft ferromagnetic material shows a rather low coercive force; a so-called semi-soft ferromagnetic material shows a rather high coercive force. This properties are used in a special type of anti-theft labels, e.g. for preventing the theft from clothes out of shops, called EM-EAS labels (Electro Magnetic Electronic Article Surveillance). The principle works as follows. A label carrier is covered on one side with a soft magnetic layer having a coercive force of about 0.5 Oe, and on the other side with a semi-soft magnetic layer having a coercive force of about 100 Oe. The detection zone consists of a transmitter which transmits an alternating magnetic field with a force $Z_M$ positioned between 0.5 and 100 Oe, and of a receiver.

Figure 2:
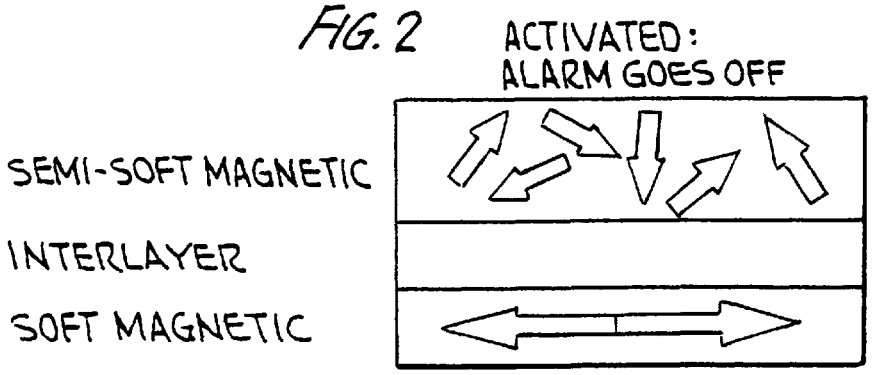
Figure 3:
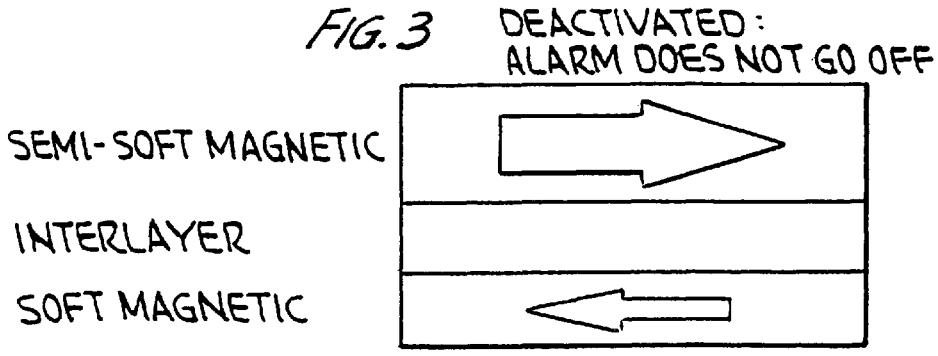

Under normal conditions the soft magnetic material will follow the alternating magnetic field. This is the case when the semi-soft layer is not magnetized (active situation). When one walks with this label through the detection zone the reversing of the magnetic dipole due to the high permeability (>40,000) will be detected by the receiver and as a consequence an alarm will go off. On the contrary, when the semi-soft layer is magnetized the soft material will be magnetized as well in the opposite sense. The transmitter is in this case not able to influence the soft magnetic material since the field strenght of the semi-soft material is larger than the strenght of the transmitted alternating field. As a consequence nothing is detected. The situations explained are briefly summarized in FIG. 2 and FIG. 3.

For a particular brand of commercially available labels the semi-soft magnetic layer consists of a nickel mesh, and the soft magnetic layer consists of a complex alloy of $Ni_aFe_bCo_c$ (MO) $_dB_e$. The problem with these magnetic layers is the fact that they are nowadays applied by means of sputtering in vacuo, a cumbersome and expensive technique.

OBJECTS OF THE INVENTION

It is an object of the present invention to provide a simple and cheap method for producing soft and semi-soft magnetic layers.

It is a further object of the invention to provide a use for such magnetic layers in the design of EM-EAS labels.

SUMMARY OF THE INVENTION

The above mentioned objects are realised by providing a process for the preparation of a magnetic element comprising a support and at least one magnetic layer, said process comprising the steps of:

(1) preparing an aqueous solution containing one or more type of metal ions including nickel ions, (2) chemically reducing said one or more metal ions by means of a reducing agent thus forming an aqueous dispersion of metal particles including nickel, (3) removing all superfluous ions from said aqueous dispersion by means of a washing step, preferably an ultrafiltration and/or diafiltration step, or by means of centrifugation, (4) coating the resulting aqueous dispersion onto a support.

DETAILED DESCRIPTION OF THE INVENTION

The present invention will now be explained on the hand of a preferred embodiment whereby the metal ions undergoing reduction are solely nickel(II) ions.

In a first step an aqueous solution of nickel(II) ions is prepared. A most suitable salt is $Ni(NO_3)_2.6H_2O$. The solution is acidified with a small amount of nitric acid.

In a following step the nickel ions in the solution are reduced to highly dispersed metallic nickel particles of nanosize by means of the addition of a reducing agent. A preferred reducing agent is $KBH_4$. The reducing agent can be added to the original nickel salt solution as a solid powder. More preferably, the reducing agent may be dissolved separately in a second aqueous medium and added to the nickel salt solution according to a single jet or a double jet procedure. Preferably, according to the double jet principle, the aqueous medium containing the nickel ions and the second solution containing the reducing agent are added together to a third aqueous medium.

The second aqueous solution comprising the reducing agent preferably also contains sulphite ions which strongly enhance the chemical stability of this solution.

In order to keep the nickel nanoparticles formed by reduction in colloidal dispersion a protective binder is preferably added to one or more of the three aqueous solutions involved. Preferably, this protective binder is added to the third aqueous medium wherein both others are jetted. A particularly preferred protective binder is carboxymethylcellulose (CMC). Other possible binders include gelatin, arabic gum, poly(acrylic acid), cellulose derivatives and other polysaccharides.

Preferably also a complexing agent is present in one of the three aqueous media described above. A preferred complexant is simply the well-known ethylenediaminetetraacetic acid (EDTA) or a homologous compound or a salt thereof. Another preferred one is citrate, e.g. triammonium citrate. Other suitable complexants include diethylenetriaminepentaacetic acid (DTPA), trans-1, 2-diaminocyclohexane-N,N,N',N'-tetraacetic acid (CDTA), ethyleneglycol-O,O'-bis(2-aminoethyl)-N,N,N',N'-tetraacetic acid (EGTA), N-(2-hydroxyethyl)ethylenediamine-N,N,N'-triacetic acid (HEDTA), etc. The complexing agent is preferably present in the third aqueous medium to which the other solutions are added according to the double jet principle.

In a following step 3 of the present invention the superfluous salts are first removed from the aqueous medium by a washing process, preferably involving ultrafiltration and/or diafiltration. Additionally or alternatively centrifugation can be used.

In any of the solutions involved in the preparation a so-called dispersing aid can be present. In a preferred embodiment this compound is added to the diafiltration liquid at the last stage of the preparation. Suitable dispersing aids in the case of nickel are phosphates, more particularly a hexametaphosphate such as sodium hexametaphosphate. Probably, the hexametaphosphate adsorbs to the surface of the alloy particles so that they become negatively charged. By electrostatic repulsion they are kept in dispersion. Also the phosphate inhibits further oxidation of the surface of the formed nanoparticles. In other words, the thin nickel oxide shell that will be formed inevitably around the nanoparticles since the reducing medium disappears during the washing step will be passivated by the hexametaphosphate. So in a preferred embodiment the nickel particles are ultrafiltrated e.g. through a Fresenius F60 cartridge and subsequently diafiltrated against a solution of sodium hexametaphosphate in water/ethanol (98.5/1.5). Apart from the diafiltration liquid the hexametaphosphate is also preferably added to the third aqueous solution.

Preferably after the addition of one or more coating agents the obtained final colloidal composition is coated on the substrate by means of a conventional coating technique, such as slide hopper, curtain coating and air-knife coating.

Suitable coating agents include non-ionic agents such as saponins, alkylene oxides e.g. polyethylene glycol, polyethylene glycol/polypropylen glycol condensation products, polyethylene glycol alkyl esters or polyethylene glycol alkylaryl esters, polyethylene glycol esters, polyethylene glycol sorbitan esters, polyalkylene glycol alkylamines or alkylamides, silicone-polyethylene oxide adducts, glycidol derivaties, fatty acid esters of polyhydric alcohols and alkyl esters of saccharides; anionic agenst comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as aklylamine salts, aliphatic, aromatic, or heterocyclic quaternary ammonium salts, aliphatic or heterocyclic ring-containing phosphonium or sulphonium salts. Other suitable surfactants include perfluorinated compounds.

Useful transparent organic resin supports include e.g. cellulose nitrate film, cellulose acetate film, polyvinylacetal film, polystyrene film, polyethylene terephthalate film, polycarbonate film, polyvinylchloride film or poly-α-olefin films such as polyethylene or polypropylene film. The thickness of such organic resin film is preferably comprised between 0.05 and 0.35 mm. In a most preferred embodiment of the present invention the support is a polyethylene terephthalate layer provided with a subbing layer. This subbing layer can be applied before or after stretching of the polyester film support. The polyester film support is preferably biaxially stretched at an elevated temperature of e.g. 70–120° C., reducing its thickness by about ½ to ⅙ or more and increasing its area 2 to 9 times. The stretching may be accomplished in two stages, transversal and longitudinal in either order or simultaneously. The subbing layer, when present, is preferably applied by aqueous coating between the longitudinal and transversal stretch, in a thickness of 0.1 to 5 mm. In case of a nickel magnetic recording layer the subbing layer preferably contains, as described in EP 0 464 906, a homopolymer or copolymer of a monomer comprising covalently bound chlorine. Examples of said homopolymers or copolymers suitable for use in the subbing layer are e.g. polyvinyl chloride; polyvinylidene chloride; a copolymer of vinylidene chloride, an acrylic ester and itaconic acid; a copolymer of vinyl chloride and vinylidene chloride; a copolymer of vinyl chloride and vinyl acetate; a copolymer of butylacrylate, vinyl acetate and vinyl chloride or vinylidene chloride; a copolymer of vinyl chloride, vinylidene chloride and itaconic acid; a copolymer of vinyl chloride, vinyl acetate and vinyl alcohol, etc. Polymers that are water dispersable are preferred since they allow aqueous coating of the subbing layer which is ecologically advantageous.

Alternatively, the support may be opaque, such as a paper support, e.g. a plain paper support or a polyolefin coated paper. Furtheron glass, e.g. thin glass packed on roll can be used.

The coated substantially pure nickel layer is ferromagnetic of the so-called semi-soft type.

In a further important embodiment of the present invention the nickel ions are not the sole ion type undergoing reduction but they are mixed with one or more other types of ions. Preferred types of salts for admixture with the nickel salt are iron salts, cobalt salts or molybdene salts, or mixtures of those.

By choosing the appropriate type(s) of ions and the appropriate admixture ratio(s) so-called soft magnetic layers can be prepared.

In a particular embodiment of the present invention a support, preferably a paper support, is coated on one side with a soft magnetic layer based on substantially pure nickel, and on the opposite side with a soft magnetic layer based on an admixture of nickel particles with other metal particles. When this material is cut into small dimensions the resulting labels can be used in a EM-EAS system (Electro Magnetic Electronic Article Surveillance)

The present invention will now be illustrated by the following examples without however being limited thereto.

EXAMPLES

Example 1

Preparation of a magnetic material (NiFe).

The following solutions were prepared:

| | |
|---|---|
| Solution 1 | |
| $Ni(NO_3)_2 \cdot 6H_2O$ | 41.8 g |
| $Fe(SO_4)_2 \cdot 6H_2O$ | 14.3 g |
| water to | 150 ml |
| $HNO_3$ | 3 ml |
| Solution 2 | |
| Water | 150 ml |
| $NH_3$ (26% in water) | 0.5 ml |
| $KBH_4$ | 10 g |
| $Na_2SO_3$ | 2 g |
| Solution 3 | |
| Na6P6O18 (2% in water/ethanol (85/15) | 100 ml |
| Triammoniumcitrate (70% in water) | 9.1 ml |
| Carboxymethylcellulose (3% in water) | 25.5 ml |

The Ni-Fe-dispersion was prepared as follows:

To solution 3, held at room temperature and stirred at 300 rpm, solution 1 at a flow rate of 12.4 ml/min was simultaneously added with solution 2 at 12.4 ml/min. After the reduction, the NiFe dispersion was ultrafiltrated through a Fresenius F60 cartridge and diafiltrated with a 0.36% solution of sodium hexametaphosphate in water/ethanol (98.5/1.5).

The dispersion was stirred and 10 ml of a 12.5% solution of Saponine Quillaya (Schmittmann) in water/ethanol (80/20) was added. This is the Ni-Fe dispersion.

The dispersion was analysed for its particle size distribution (weight average $d_{wa}$) with the Disc Centrifuge Photosedimentometer BROOKHAVEN BI-DCP. A $d_{wa}$ of 56 nm ($s_{wa}$=10) was obtained.

Subsequently this dispersion was coated on a substrated PET foil so that an amount of 0.90 g/m$^2$ was obtained.

A Squid magnetometer was used to measure the magnetic properties. A coercive field of 110 Oe was measured.

What is claimed is:

1. Process for the preparation of a magnetic element comprising a support and at least one magnetic layer, said process comprising the steps of:

(1) preparing an aqueous solution containing one or more type of metal ions including nickel(II) ions, (2) chemically reducing said one or more metal ions by means of a reducing agent thus forming an aqueous dispersion of metal particles including nickel, (3) removing all superfluous ions from said aqueous dispersion by means of a washing step or by means of centrifugation, wherein said washing step involves an ultrafiltration and/or diafiltration step and wherein a phosphate is present as dispersing aid during the ultrafiltration and/or diafiltration step, (4) coating the resulting aqueous dispersion onto a support.

2. Process according to claim 1 wherein said reducing agent is added by means of a separate second aqueous solution.

3. Process according to claim 2 wherein said separate second aqueous solution further contains sulphite ions.

4. Process according to claim 1 wherein said reducing agent is $KBH_4$.

5. Process according to claim 1 wherein said metal ions beside nickel ions further comprise iron ions, cobalt ions or molybdene ions, or mixtures of those, thus giving rise after completing steps (1) to (4) to a soft magnetic layer.

6. Process according to claim 1 wherein said metal ions are substantially solely nickel(II) ions thus giving rise after completing steps (1) to (4) to a semi-soft magnetic layer.

7. Process according to claim 1 wherein said phosphate is a hexametaphosphate.

* * * * *